US007430844B2

(12) United States Patent
Buchman et al.

(10) Patent No.: US 7,430,844 B2
(45) Date of Patent: Oct. 7, 2008

(54) DUPLEX PACKAGING MACHINE

(75) Inventors: James E. Buchman, Hortonville, WI (US); Paul A. Tilman, Sherwood, WI (US)

(73) Assignee: Alcoa, Inc., Appleton, WI (US)

( * ) Notice: Subject to any disclaimer, the term of this patent is extended or adjusted under 35 U.S.C. 154(b) by 0 days.

(21) Appl. No.: 11/734,335

(22) Filed: Apr. 12, 2007

(65) Prior Publication Data

US 2007/0175180 A1 Aug. 2, 2007

Related U.S. Application Data

(62) Division of application No. 11/063,215, filed on Feb. 22, 2005, now Pat. No. 7,219,481.

(51) Int. Cl.
*B65B 43/04* (2006.01)
*B65B 51/04* (2006.01)
*B31B 1/90* (2006.01)

(52) U.S. Cl. ..... 53/562; 53/133.4; 53/139.2; 493/214; 493/927; 29/409

(58) Field of Classification Search ..... 493/186, 493/213, 214, 927; 53/412, 455, 135.2, 562, 53/570, 133.4, 139.2; 383/61.2, 64; 318/560, 318/568.31, 625; 29/409, 410, 766–769
See application file for complete search history.

(56) References Cited

U.S. PATENT DOCUMENTS 4,128,985 A * 12/1978 Simmons ..... 53/51
4,800,707 A * 1/1989 Rabus ..... 53/552
4,812,074 A * 3/1989 Ausnit et al. ..... 493/213
4,876,842 A * 10/1989 Ausnit ..... 53/410
5,247,781 A 9/1993 Runge
RE34,905 E * 4/1995 Ausnit ..... 53/412
5,713,669 A 2/1998 Thomas et al.
5,956,924 A * 9/1999 Thieman ..... 53/412
6,138,439 A 10/2000 McMahon et al.
6,161,271 A * 12/2000 Schreiter ..... 29/408
6,216,423 B1 4/2001 Thieman
6,293,896 B1 9/2001 Buchman
6,347,437 B2 2/2002 Provan et al.
6,389,780 B1 5/2002 Coomber et al.
6,397,557 B1 * 6/2002 Bassissi et al. ..... 53/51
6,427,421 B1 * 8/2002 Belmont et al. ..... 53/412
6,470,551 B1 * 10/2002 Provan et al. ..... 29/408
6,477,820 B1 11/2002 Dutra et al.
6,517,242 B1 2/2003 Buchman
6,517,473 B1 * 2/2003 Cappel ..... 493/213

(Continued)

*Primary Examiner*—Paul R Durand
(74) *Attorney, Agent, or Firm*—Merchant Gould P.C.

(57) ABSTRACT

A method of making and filling reclosable packages using a duplex machine includes the steps of providing a zipper profile, package film and a plurality of sliders; feeding the zipper profile; applying the sliders to the zipper profile; coupling the zipper profile to the folded web; sealing two edges of the folded web to form adjacent pouches; filling the pouches; sealing the pouches proximate a third edge thereof; and separating the pouches in order to form individual packages. The method employs a single rotating slider applicator having a programmable servo motor which is programmed in order to synchronize the application of the sliders to the moving zipper profile with the two at a time form, fill, seal and separate packaging operations of the duplex machine. A duplex machine is also disclosed.

7 Claims, 6 Drawing Sheets

U.S. PATENT DOCUMENTS 6,572,266 B2 6/2003 Buchman
6,780,146 B2 * 8/2004 Thomas et al. ..... 493/213
6,823,647 B2 11/2004 Kinigakis et al.
6,834,474 B2 * 12/2004 Dutra et al. ..... 53/133.4
7,093,409 B2 8/2006 Dutt et al.
7,219,481 B2 5/2007 Buchman
2002/0152719 A1 * 10/2002 Kinigakis et al. ..... 53/412

* cited by examiner

DUPLEX PACKAGING MACHINE

This application is a divisional application of U.S. application Ser. No. 11/063,215, filed Feb. 22, 2005 now U.S. Pat. No. 7,219,481.

BACKGROUND OF THE INVENTION

1. Field of the Invention

The present invention relates generally to reclosable packages and, more particularly, to a method of applying sliders to reclosable plastic bags using a duplex packing machine. The invention also relates to a duplex form, fill and seal packaging machine and to a slider applicator for a duplex packaging machine.

2. Description of the Related Art

Reclosable packages, such as, for example, slider-activated reclosable plastic bags, generally include a folded web, or pouch, and a zipper profile which receives a moveable slider used to open and reclose the pouch. When used to package goods, such as, for example, food items packaged for commercial sale, such packages often further include a removable header portion used to provide an additional, tamper evident seal of the pouch. Such header portion is located above the zipper profile and slider at the top of the package. Typically, the header portion is torn off or otherwise removed and discarded, in order to access the slider and thus open the pouch.

Such packages are usually mass produced using a packaging machine which performs forming, filling, sealing and cutting, or separating, operations sequentially, typically in a horizontal fashion. It is desirable to produce the packaged goods as quickly and efficiently as possible. Therefore, packaging machines commonly referred to in the art as duplex machines, have been developed. A duplex machine gets its name from the fact that it provides for the forming, filling, sealing and subsequent separation of two packages at a time, as opposed to requiring each package to be completed individually, before preparation of the next package is initiated. Duplex machines are, therefore, advantageous in that they are essentially twice as fast.

However, while duplex machines can typically employ two hoppers for simultaneously filling the packages, double sealing jaws for sealing the edges of two packages, and two cutters for subsequently simultaneously separating two finished packages, known duplex machines cannot employ two slider applicators. The application of sliders to the packages, in order to create a reclosable zipper has, therefore, not yet been adapted to be sufficiently compatible with the duplex running condition. The difficulty arises in that the zipper profile after being threaded through a first applicator in order to receive a slider, cannot, with the slider attached, pass through a second applicator in order to receive the second slider. Hence, the series of packages must be intermittently stopped in order to apply the sliders one at a time, thereby defeating the two at a time speed advantages of the duplex running condition.

There is a need, therefore, for an improved, more efficient packaging system and method which enables the application of sliders two at a time in order to be compatible with a duplex form, fill and seal machine and thereby increase production output.

SUMMARY OF THE INVENTION

The present invention has met the above-described need, and others, by providing a method and apparatus for continuously applying a plurality of sliders to a moving zipper profile as part of a reclosable bag packaging process using a duplex form, fill and seal packaging machine. Through use of a programmable electric servo motor controlling a rotating slider applicator, the present invention allows slider-activated reclosable packages to be made on the duplex packaging machine in harmony with the machine's duplex running condition (e.g., two at a time).

In a first embodiment, a method of making and filling reclosable packages using a duplex packaging machine comprises the steps of: providing a zipper profile, package film and a plurality of sliders; feeding the zipper profile; apply the sliders to the zipper profile; coupling the zipper profile to the folded web; sealing two edges of the folded web to form a pair of adjacent pouches; filling the pouches; sealing the pouches proximate a third edge thereof; and separating the pouches in order to form individual packages.

It is an object of the present invention to provide an improved method of packaging, an improved duplex packaging machine and a slider applicator for a duplex packaging machine, wherein the sliders are applied continuously, two packages at a time, without requiring the packaging system to be intermittently stopped or paused at each package.

It is another object of the present invention to provide a slider applicator for continuously applying sliders to moving zipper profiles.

It is a further object of the present invention to provide a duplex packaging machine employing the aforementioned slider applicator.

It is yet another object of the present invention to provide a programmable electric servo motor for controlling the speed of the slider applicator.

It is a still further object of the present invention to provide a single slider applicator which is a rotating slider applicator that can be programmed to be compatible with the duplex running condition of the duplex form, fill and seal packaging machine.

These and other objects of the invention will be more fully understood from the following description of the invention with reference to the drawings appended hereto.

DETAILED DESCRIPTION

Figure 1:
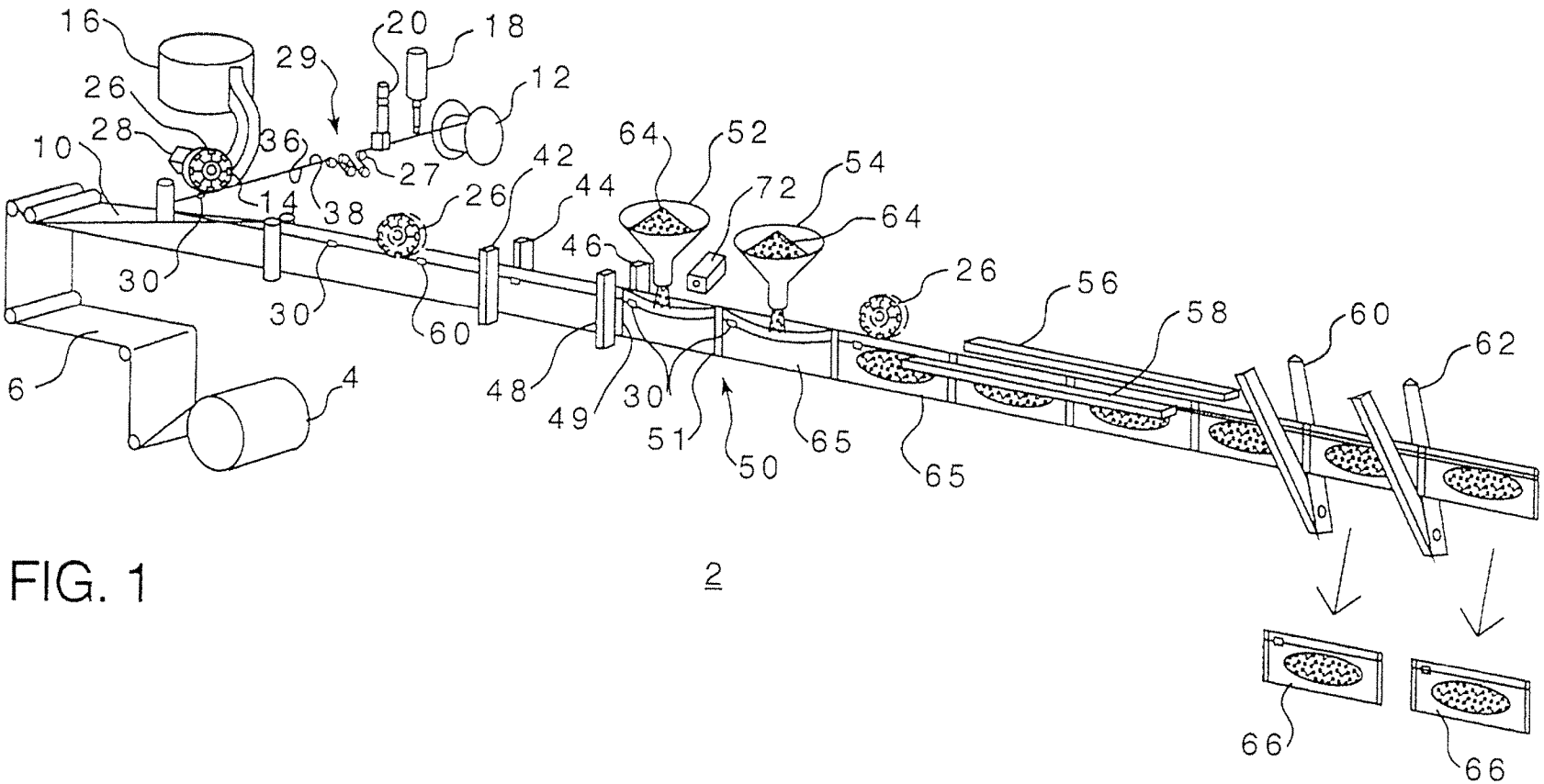
FIG. 1 is an isometric view of a horizontal form, fill and seal duplex packaging machine in accordance with the present invention.

Directional phrases used herein, such as, for example, top, bottom, left, right, clockwise, counterclockwise and derivatives thereof, relate to the orientation of the elements in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or more than one (i.e, a plurality).

Figure 2:
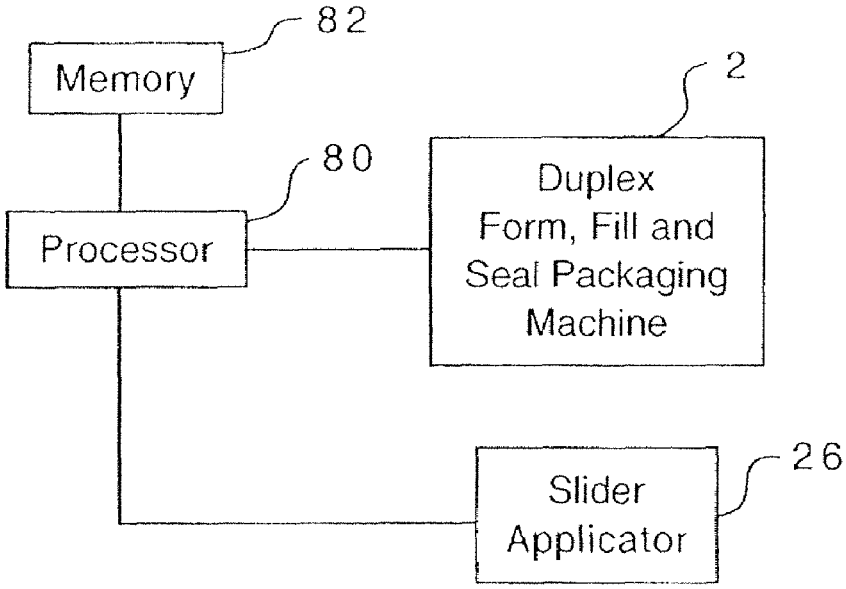
FIG. 2 is a block diagram of the duplex packaging machine of FIG. 1.

An improved duplex packaging machine 2, slider applicator 26 therefor and method of applying sliders 30 using the duplex machine 2 and applicator 26 in accordance with the invention, are shown generally in FIGS. 1 and 2. The duplex packaging machine shown and discussed herein is a representative example of a horizontal form, fill and seal duplex machine 2. However, it will be appreciated that the methods and apparatus of the invention are also applicable to other types of packaging machines (not shown) including, for example, without limitation, vertical form, fill and seal duplex packaging machines (not shown). It will also be appreciated that the apparatus and method of the invention could readily be adapted to packaging systems structured to make and fill packages one at a time or at a rate greater than two at a time (e.g., three or more packages at a time).

The duplex machine 2 includes a film roll 4 which supplies package film 6 to the duplex machine 2 in order to be sequentially formed, filled and sealed and ultimately, to create a plurality of resultant individual packages 66. As can be understood by reference to the example of FIG. 1, generally, the package film 6 is first folded into a folded web 8 using a folding board such as the generally V-shaped folding board 10, shown. It will be appreciated that any known or suitable alternative folding board configuration (not shown) is also within the scope of the invention. A zipper profile comprising first and second interlockable zipper profiles 36, 38 which are structured to be attached to the tops of the sides of the folded web 8, is then fed from a zipper profile roll 12. As the zipper profile 36, 38 is being fed from the spool or roll 12, an ultrasonic crushing unit (shown generally in FIG. 1 as reference 18), for example, or other known or suitable crushing device (not shown) is used to create crushed areas 24 (best shown in FIG. 7) on the zipper profile 36, 38. The crushed areas 24 (FIG. 7) are created a package width apart from one another and, in combination with a notch 22 in the profile, created adjacent each crushed area 24 (best shown in FIG. 7), facilitate the receipt and retention of the sliders 30. It is understood that the machine 2 is an intermittent motion machine and, therefore, stops every other pouch 65 to fill product 64 into two pouches 65 at a time. Accordingly, in order to apply two crush areas 24, and two notch areas 22, the example of FIG. 1 employs a dancer system 29 in order to take up sufficient length of the zipper profiles 36, 38 between stop cycles. The exemplary dancer system 29 (FIG. 1) includes a number of rollers including a set of nip rollers 27 which control the start and stop cycle of the zipper profiles 36, 38 in order to accomplish the crush 24 and notch 22 as the rest of the machine 2 continues to cycle. In other words, the zipper profile 36, 38 starts and stops twice for every start stop cycle of the machine 2. Thus, a reclosable zipper 40 is formed and coupled to the folded web 8. It will, however, be appreciated that any know or suitable alternative apparatus or method for creating notches 22 and crushed areas could be employed. For example, two ultra sonic crushing units 18 and two notch punches 20 could be employed in a suitable configuration (not shown). The zipper 40, slider 30 and the apparatus and method for creating the same will be discussed in greater detail hereinafter.

During the packaging process, the folded web 8 continues down the duplex machine as a number of subsequent steps are sequentially performed, two at a time, and the individual packages 66 are completed. Among the steps is the step of sealing the folded web 8 to define substantially vertical edges 49, 51 of the individual packages 66. The exemplary method of sealing the edges involves compressing the folded web 8 between two pairs of opposing sealing jaws 42, 44, 46, 48. The exemplary sealing jaws are substantially vertical heater bars 42, 44, 46, 48 although other known or suitable sealing mechanisms (not shown) could be employed without departing from the scope of the invention. More specifically, the package film 6 is typically a meltable plastic material such as, for example, without limitation, low density polyethylene. The heater bars 42, 44, 46, 48 are pressed laterally against the folded web 8, melting it in order to form a pair of edges 49, 51 which define the width of the package 66, as shown in FIG. 1. In this manner, a pair of adjacent pouches 65 which are fillable, sealable and separable in order to become individual packages 66, are formed. Each package 66 includes a reclosable zipper 40 having one slider 30 contained between the pair of edges 49, 51 of the package 66. The slider 30 slides on the zipper profile 36, 38 between an open (FIG. 1) and a closed (FIG. 8) position corresponding to the package 66 being open and closed, respectively.

Next, the pair of adjacent pouches 65 are filled with product 64 at a filling station 50 having a pair of product hoppers 52, 54 in order to fill the pouches 65 two at a time. It will be appreciated that the product 64 may be any known or suitable good conducive to packaging within individual re-closable packages, like the exemplary slider-activated reclosable plastic bags 66. For example, without limitation, food goods, such as coffee, jelly beans and grated cheese are often packaged in such a manner. The product 64 is released from the two hoppers 52, 54 until two pouches 65 at a time are filled to the desired level. The hoppers 52, 54, like all operations of the duplex machine 2, are programmable, as will be discussed in greater detail herein.

Following the filling station 50, the tops of the filled pouches 65 are sealed two at a time to create a header portion 68. This operation, in the example of FIG. 1, is performed using a pair of generally horizontal opposing double-wide sealing bars 56, 58. The sealing bars are double-wide in that they have a length generally equivalent to the width of two packages 66 in a series of packages, as shown. The exemplary sealing bars 56, 58, like the aforementioned sealing jaws 42, 44, 46, 48, are heater bars which melt the plastic material of the top of the package 66 in order to seal it. In this manner, the header portion 68 creates a tamper evident device which must be torn away or otherwise removed by a user, in order to access the zipper 40 and open the package 66.

Finally, the completed pouches 65 which have been formed, filled and sealed in accordance with the foregoing duplex packaging running condition, are separated two at a time into individual, completed packages 66. A pair of cutters 60, 62 performs the separating operation in the example of FIG. 1.

As previously discussed, known duplex packaging systems have had substantial difficulty applying sliders two at a time in coordination with the duplex running condition of the duplex machine 2. Accordingly, prior art production of slider-activated reclosable packages 66 has not been able to take advantage of fast and efficient duplex production capabilities. The invention overcomes this disadvantage by providing a slider applicator 26 and method of applying sliders 30 which can be readily employed with a duplex packaging machine (e.g., duplex machine 2) while taking full advantage of the two at a time, duplex running condition of the machine.

Continuing to refer to FIGS. 1 and 2, the exemplary slider applicator is a rotary slider applicator 26 having a programmable servo motor 28. The servo motor 28 like each of the apparatus of all of the aforementioned duplex packaging operations (e.g., forming, filling, sealing and cutting), is programmable. A processor 80, which may be, without limitation, a microprocessor (.mu.P) or a computer, is programmed by a user or operator of the duplex machine 2 to provide outputs to the machine 2 in order to perform the desired packaging operation. In other words, the processor 80 effectuates functions that a user programs it to perform. As used herein, the term "function" and variations thereof can refer to any type of process, task, operation, procedure, routine, subroutine, function call or other type of software or firmware operation that can be performed by the processor 80 (FIG. 2) of the duplex machine 2. Thus, in the aforementioned example, illustrated in FIG. 1, the forming, filling, sealing, separating and the application of the sliders 30 to the packages 66, are user-programmed functions controlled by the processor 80.

As shown in FIG. 2, in addition to the slider applicator 26 and the duplex machine 2 in general, the processor 80 is in electrical communication with memory 82. Memory 82 can be of any of a variety of internal and/or external storage media such as, without limitation, RAM, ROM, EPROM(s), EEPROM(s), and the like, that provide a storage register for data storage such as in the fashion of an internal storage area of a computer (not shown), and can be volatile memory or involatile memory. The memory 82 further includes a number of the foregoing functions or operations which are executable by the processor 80 for the processing of data. The functions, as previously discussed, can be in any of a variety of forms and can include one or more routines, subroutines, operations, function calls, or the like, alone or in combination. In this manner, the programmable servo motor 28 is programmed to control the speed of the exemplary rotary slider applicator 26 in a manner compatible with the duplex running condition of the duplex packaging machine 2. Specifically, the memory 82 stores one or more programmable functions executable by the processor 80. The one or more functions are adapted to perform the aforementioned form, fill, seal, separate and slider applicator packaging operations, two at a time, in accordance with the duplex running condition of the exemplary duplex machine 2.

Figure 3:
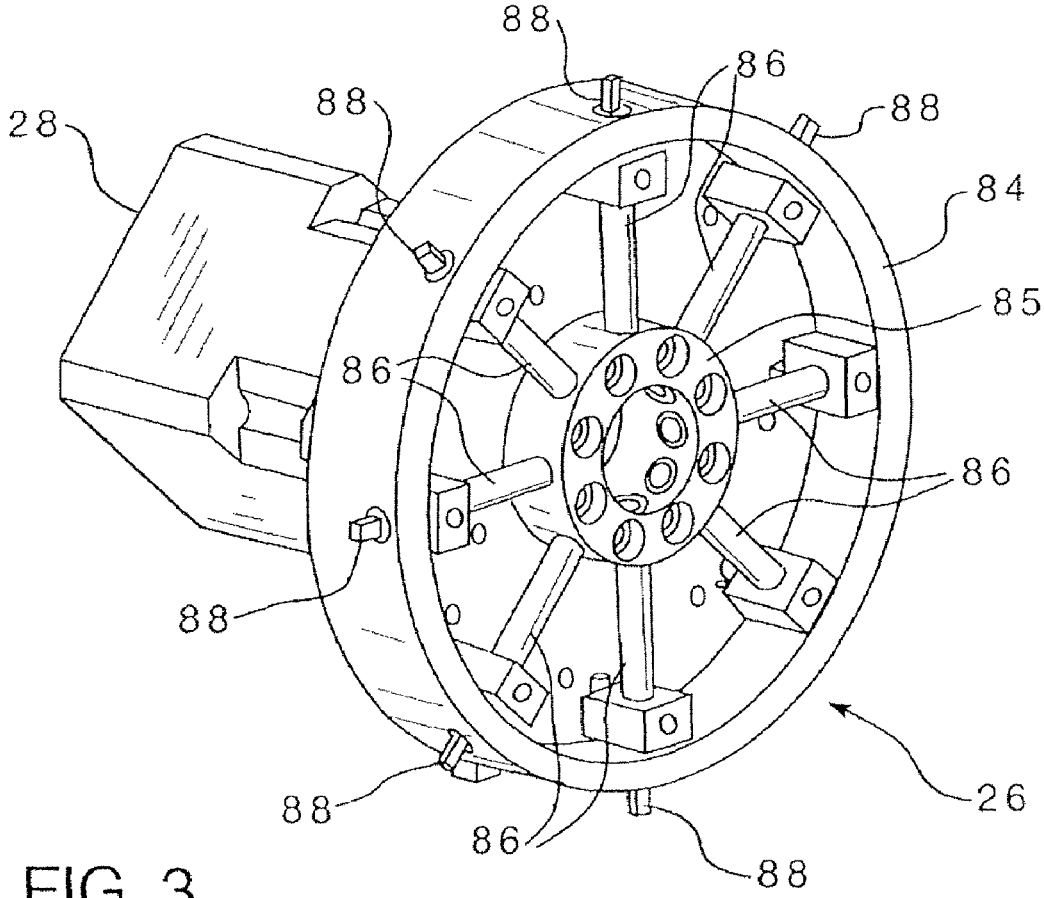
FIG. 3 is an isometric view of the slider applicator and electric servo motor therefor, of FIG. 1.
Figure 4:
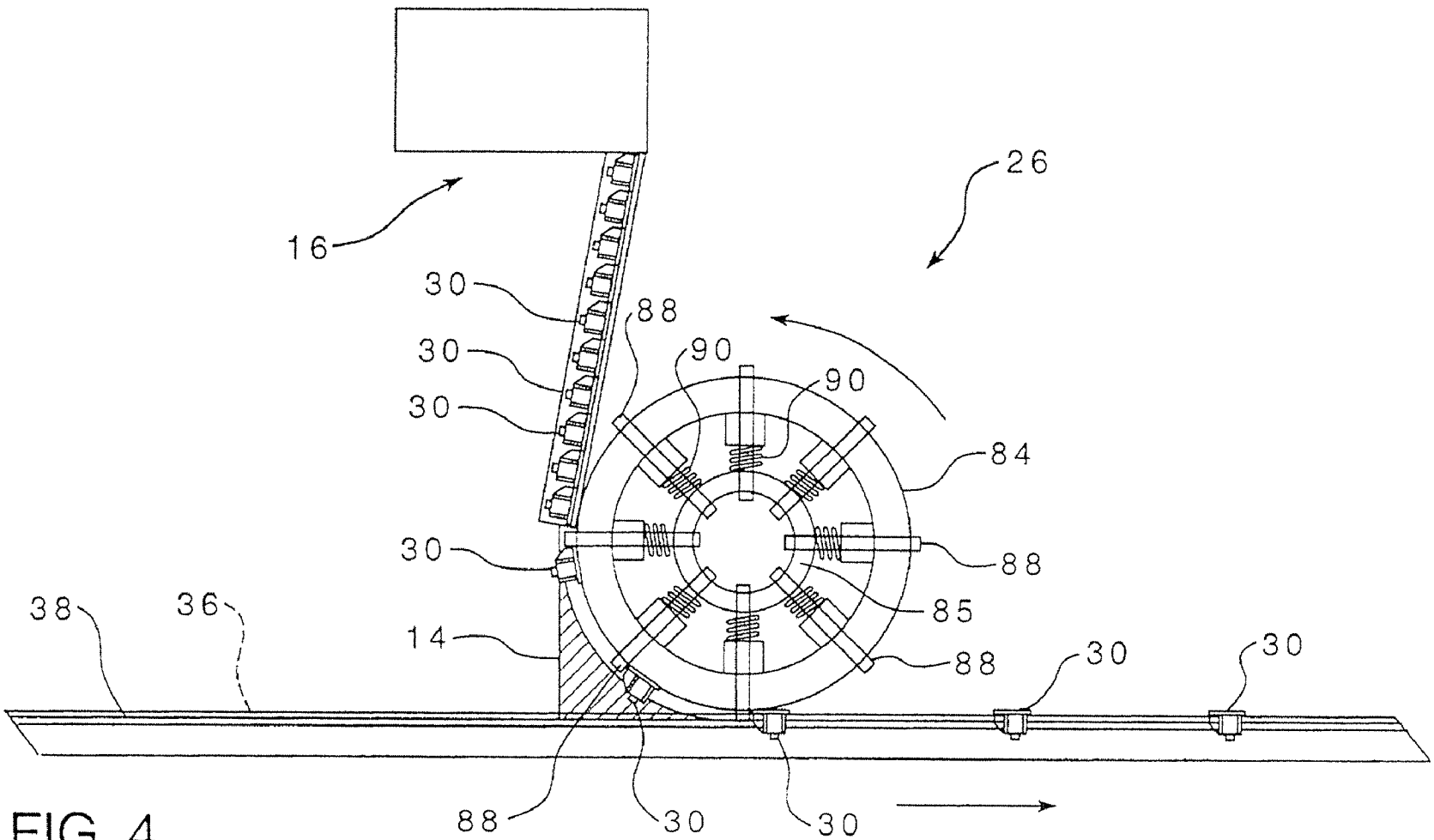
FIG. 4 is a side view of the slider applicator of FIG. 1, shown rotatably applying sliders to the zipper profile for a series of adjacent pouches.

FIGS. 3 and 4 show the exemplary rotary slider applicator 26 in further detail. As shown in FIG. 3, the rotary slider applicator 26 includes a wheel member 84 having a plurality of extendable spokes 86 which extend from a central hub portion 85. In the example of FIG. 3, seven extendable spokes 86 extend from hub portion 85. The exemplary wheel member 84, hub portion 85 and extendable spokes 86 are made from metal, although any known or suitable alternative material could be employed. The spokes 86 are extendable in that they include a compressive spring (not shown in FIG. 3), such as the linear spring 90 shown in FIG. 4, which biases an outer end of the spoke 86 outward, away from the hub, in order to form a projection 88 which project beyond the circumference of the wheel member 84. The rotational speed of the wheel member 84 is controlled by the programmable servo motor 28 (FIG. 3). Of course, other suitable alternative rotating slider applicator configurations could be employed without departing from the concept of the invention.

As best shown in FIG. 4, in operation, the plurality of sliders 30 are fed by a slider supply 16 which may comprise a bowl and track, as shown, or any known or suitable alternative supply mechanism (not shown). A series of sliders 30 are fed from the slider supply 16 towards the wheel member 84 which is adjacent the moving slider profile (interlockable first and second slider profiles 36, 38). The wheel member 84 rotates counterclockwise (from the perspective of FIG. 4) in order that each projection 88 thereof engages a slider 30 and pushes it through an expander track 14 guiding it towards the moving zipper profile 36, 38 (zipper profile 36, 38 is moving to the right, from the perspective of FIG. 4) for application thereto. As previously discussed, the programmable servo motor 28 (FIG. 3) is programmed to control the speed of the rotating slider applicator 26 during this operation in a manner that is compatible with the movement of the zipper profile 36, 38 as it moves through the duplex machine 2 (FIG. 1).

Figure 5:
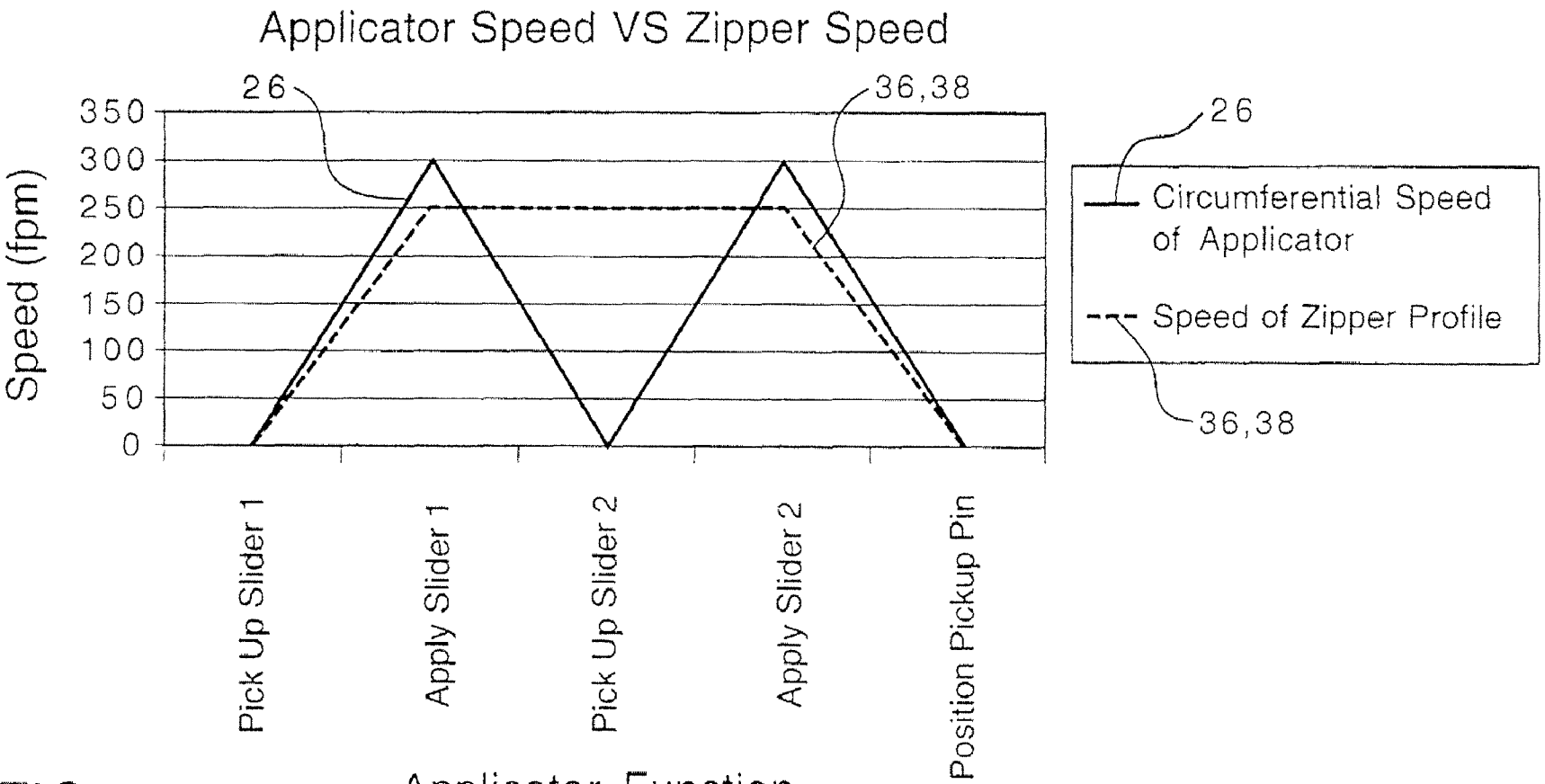
FIG. 5 is a graph plotting zipper speed and applicator speed during application of the sliders to the zipper profile.

The graph of FIG. 5 illustrates the rotating slider applicator 26 speed versus the speed of the zipper profile 36, 38 (FIG. 4) as two sliders 30 are applied to the profile 36, 38. Specifically, the circumferential speed of the rotating slider applicator 26 is represented by the solid line shown on the graph of FIG. 5 and the speed of the zipper profile 36, 38 is represented by the dashed line, which is plotted over top of the solid line (applicator speed), for comparative purposes. The two speeds are plotted for a duration of two sliders 30 (FIG. 1) being applied to the zipper profile 36, 38 (FIG. 1) in accordance with the duplex running condition of the exemplary duplex machine 2 (FIG. 1). As shown, the zipper profile 36, 38 moves at a relatively constant speed as it progresses two package widths at a time at a speed of about 250 feet per minute. To coordinate the application of slider 30 to the moving zipper profile 36, 38, the programmable servo motor 28 (FIG. 3) is programmed to slow the wheel member 84 (FIGS. 3 and 4) down to pick-up, or engage, a slider 30 (best shown in FIG. 4), then speed the counterclockwise rotation (with respect to FIG. 4) of the wheel member 84 up in order to apply the first slider 30 to the zipper profile 36, 38. Application of the first slider 30 is represented on the graph of FIG. 5 by the first peak, at which point the circumferential speed of the wheel member 84 is about 300 feet per minute. The wheel member 84 (FIGS. 3 and 4) is programmed to then slow down at a substantially linear rate, as shown, in order to pick up the second, or next, slider 30. The programmed servo motor 28 then speeds up the wheel member 84 again at a substantially linearly, as the projection 88 (FIG. 4) of the wheel member 84 guides the second slider 30 towards the moving zipper profile 36, 38 and applies it thereto at a peak speed of about 300 feet per minute. Finally, both the wheel member 84 and the zipper profile 36, 38 slow down and temporarily stop as subsequent filling operations, for example, occur downstream of the slider applicator 26 operation. The foregoing sequence is repeated as many times as necessary in order to complete a series of individual packages 66 (FIG. 1) two at a time.

Accordingly, the invention provides a single slider applicator 26 which synchronizes critical ramp-up and ramp-down speeds in order to apply the sliders 30 at the appropriate spacing on the zipper profile 36, 38, while taking advantage of the efficient duplex running condition of the duplex machine 2. As discussed, it will be appreciated that alternative configurations of the rotating slider applicator 26 could be employed within the scope of the invention. For example, the slider applicator 26 could be employed at a number of alternative locations along the exemplary horizontal duplex form, fill and seal packaging machine 2 (FIG. 1). These alternative locations are shown in phantom line drawing in FIG. 1. A first alternative location places the slider applicator 26 just before the first pair of sealing jaws 42,44. A second alternative location places the slider applicator 26 after the filling station 50. Other locations (not shown) could also be utilized. For simplicity of illustration, only the rotating slider applicator 26 is shown at the aforementioned alternative locations.

It will also be appreciated that an alternative or additional mechanism for controlling the speed of the slider applicator 26, for example, could be employed. One such mechanism might be a sensor, shown generally in FIG. 1 as reference 72. The sensor 72, being located downstream from the applicator 26, for example at the filling station 50, could transmit a signal to the processor 80 in order to effectuate an appropriate servo motor 28 and thus slider applicator 26 speed compatible with the filling status of the pouch 65. Sensors (e.g., 72) might also be employed elsewhere in the series of packaging operations in order to, for example, detect when package film 6 has run out.

Figure 6:
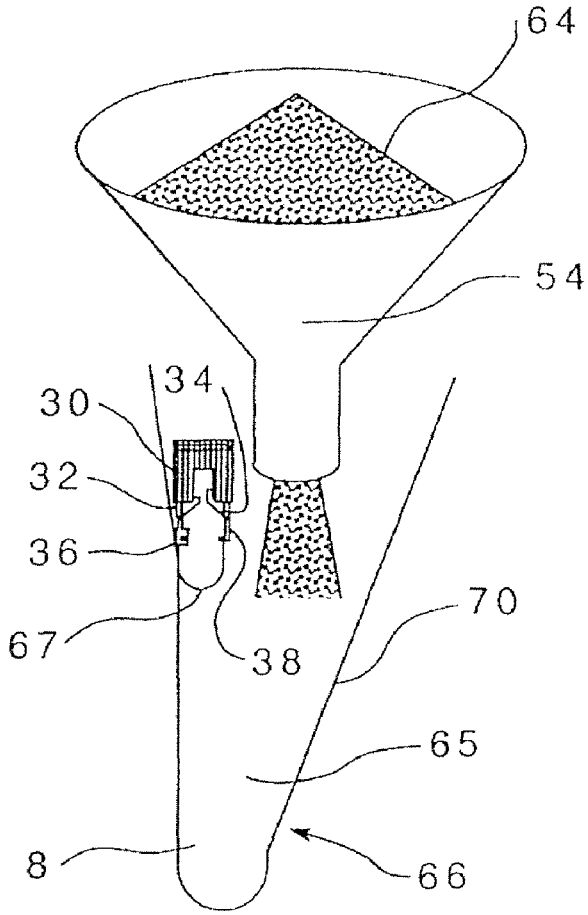
FIG. 6 is a schematic view of a package being filled in accordance with the present invention.

FIG. 6 generally shows a pouch 65 being filled with product 64 as it is released from the hopper 54. As shown, the folded web 8 comprising the pouch 65 includes a package wall 70 and a tamper evident membrane 67 generally in the shape of a loop. The tamper evident membrane 67 is formed as part of the aforementioned folding operation performed by the exemplary generally V-shaped folding board I 0. As shown, the tamper evident membrane 67 extends between the first and second interlockable zipper profiles 36, 38. The tamper evident membrane 67 serves to provide an additional tamper evidencing device, in addition to the previously discussed header portion 68, best shown in FIG. 7. It also serves to preserve freshness of the packaged product 64 by sealing it substantially air-tight within the package 66. The tamper evident membrane 67 is torn or fractured when the zipper 40 is opened for the first time upon opening the package 66.

Continuing to refer to FIG. 6, the slider 30 includes a pair of opposing foot portions 32,34. These foot portions 32,34 are resilient and are structured to be spread apart, in order to facilitate application of the slider 30 onto the zipper profile 36, 38, and then released to compress securely against the profile 36, 38 (best shown in FIG. 4). The zipper profile 36, 38 and slider 30 are preferably made from a plastic material, such as polyethylene or polypropylene, but may alternatively be made from any known or suitable material. In the exemplary method of applying sliders 30, previously discussed in connection with FIG. 4, the resilient opposing foot portions 32,34 of the slider 30 are spread apart for application to the zipper profile 36, 38 by way of the expander track 14 (FIG. 4). Specifically, the expander track 14 (FIG. 4) slightly spreads the opposing foot portions 32,34 away from one another, laterally outwards, as the projection 88 (FIG. 4) of the wheel member 84 (FIG. 4) progresses the slider 30 through the expander track 14 towards the moving zipper profile 36, 38. As the slider 30 exits the expander track 14, it is deposited onto the moving zipper profile 36, 38 and the opposing foot portions 32,34 are released in order to compress against the profile 36, 38.

Figure 7:
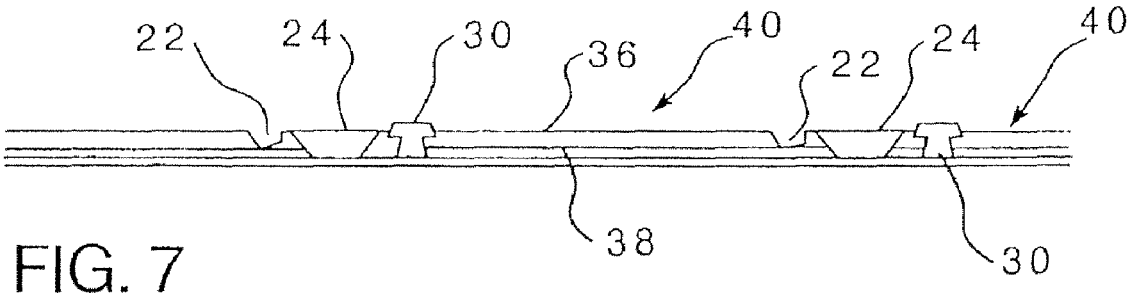
FIG. 7 is a close-up elevational view of the zipper profile at the top of two packages among a series of packages, with the notch, crushed area and slider for two consecutive packages being shown.
Figure 8:
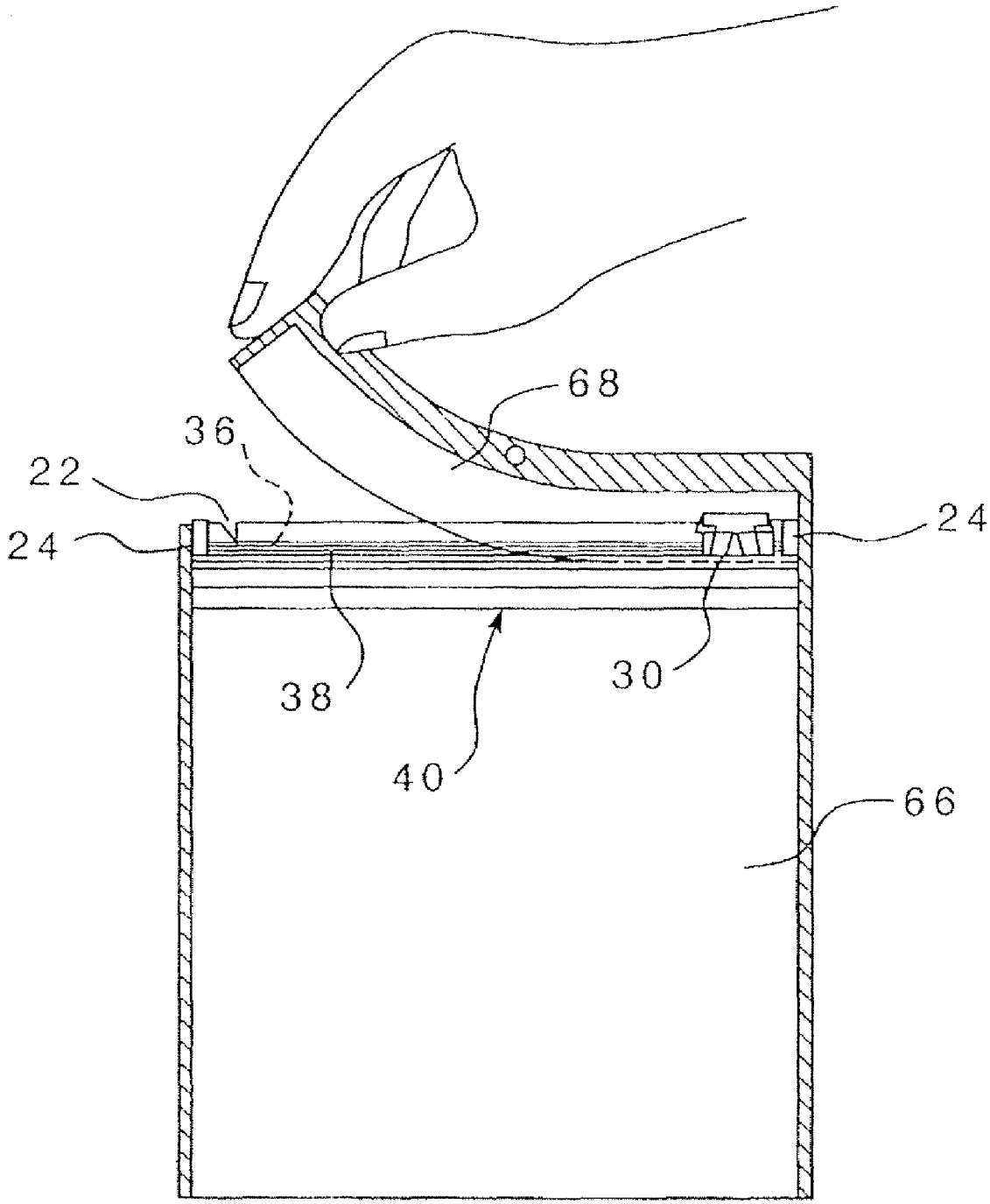
FIG. 8 is an elevational view of the header portion being removed from the top of a completed individual package.

FIG. 7 shows the reclosable zipper 40 for two consecutive pouches 65 (FIG. 1) in a series of such pouches, before being completed and separated into individual packages 66 (best shown in FIG. 8). As shown, each of the zippers 40 includes the first and second interlockable and thus reclosable zipper profiles 36, 38 and a single slider 30 operable between the crushed area 24 at one end of the zipper 40 and the notch 22 at the opposite end. The sliders in the example of FIG. 7 are shown in the open position.

FIG. 8 shows a completed individual package 66 after having been formed, filled, sealed and separated in accordance with the invention. The slider 30 is shown in the closed position. The header portion 68 is being torn away in order to access a slider 30 and open the reclosable zipper 40 in order to access the contents of the package 66.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A duplex packaging machine comprising:

a packaging film roll structured to feed package film;

a folding board structured to fold said package film into a folded web;

a zipper profile roll structured to feed a zipper profile;

a rotary slider applicator including a programmable servo motor that synchronizes the application of a plurality of sliders to said zipper profile;

substantially transverse sealing jaws structured to seal edges of said folded web in order to form a pair of adjacent pouches;

a filling station including a pair of product hoppers structured to supply product for filling said adjacent pouches two at a time;

sealing bars structured to seal said adjacent pouches proximate a third edge thereof;

package separators structured to separate a series of said adjacent pouches, in order to form individual packages;

a processor; and a memory, said memory storing one or more programmable functions executable by said processor, said one or more functions being adapted to:

feed and fold said package film in order to form said folded web, feed said zipper profile, secure said zipper profile to said zipper profile, apply said plurality of sliders to said zipper profile sequentially as said zipper profile is moving, couple said zipper profile to said folded web, seal two edges of said folded web in order to form adjacent pouches each having one of said plurality of sliders, fill said adjacent pouches, seal said adjacent pouches proximate a third side thereof, and separate said adjacent pouches in order to form individual packages.

2. The duplex packaging machine of claim 1 wherein said servo motor is programmable through said processor in order to execute the function of controlling the speed of said rotary slider applicator in order that said plurality of sliders are applied to said zipper profile at a spacing of a package width apart from one another; and wherein said rotary slider applicator synchronizes the application of said plurality of sliders with said duplex machine as it completes one or more form, fill, seal and separate packaging functions, two at a time.

3. The duplex packing machine of claim 2 wherein said rotary slider applicator includes a slider supply and a wheel member having a plurality of extendable spokes with projections structured to engage said plurality of sliders supplied by said slider supply and apply them to said moving zipper profile.

4. The duplex packaging machine of claim 3 wherein said slider applicator further includes an expander track adjacent the location of said zipper profile;

wherein each of said plurality of sliders has a pair of opposing foot portions; and wherein said function of applying said plurality of sliders to said zipper profile includes said projections of said wheel member engaging said sliders and guiding them through said expander track in order to spread said opposing foot portions thereof apart as said sliders are applied to said moving zipper profile.

5. The duplex packaging machine of claim 1 wherein said folding board is a generally V-shaped folding board.

6. The duplex packaging machine of claim 1 wherein said substantially transverse sealing jaws are two pairs of opposing heater bars; and wherein said sealing bars are a pair of generally horizontal, double-wide opposing heater bars.

7. The duplex packaging machine of claim 1 wherein said package separators are a pair of cutters which cut and separate said filled and sealed individual packages, two at a tune.

* * * * *